US006886383B2

(12) United States Patent
Kim et al.

(10) Patent No.: US 6,886,383 B2
(45) Date of Patent: May 3, 2005

(54) METHOD FOR STRETCH FORMING SHEET METAL BY PRESSING AND THE APPLICATION OF GAS PRESSURE

(75) Inventors: Chongmin Kim, Davisburg, MI (US); Gary A. Kruger, Troy, MI (US); Mark G. Konopnicki, Rochester, MI (US); Richard Murray Kleber, Clarkston, MI (US); Michelle R. Goff, Grand Blanc, MI (US)

(73) Assignee: General Motors Corporation, Detroit, MI (US)

( * ) Notice: Subject to any disclaimer, the term of this patent is extended or adjusted under 35 U.S.C. 154(b) by 214 days.

(21) Appl. No.: 10/287,466

(22) Filed: Nov. 4, 2002

(65) Prior Publication Data

US 2004/0083784 A1 May 6, 2004

(51) Int. Cl.[7] ..... B21D 26/02; B21D 25/00
(52) U.S. Cl. ..... 72/57
(58) Field of Search ..... 72/57, 63; 29/421.1

(56) References Cited

U.S. PATENT DOCUMENTS 4,045,986 A * 9/1977 Laycock et al. ..... 72/60
4,689,979 A * 9/1987 Otsuka et al. ..... 72/57
5,974,847 A 11/1999 Saunders et al. ..... 62/57
6,253,588 B1 7/2001 Rashid et al.
6,305,202 B1 * 10/2001 Kleber ..... 72/57
6,513,359 B1 * 2/2003 Binder et al. ..... 72/57
6,672,121 B2 * 1/2004 Carsley et al. ..... 72/57
6,708,543 B2 * 3/2004 Yoshioka et al. ..... 72/57

FOREIGN PATENT DOCUMENTS

JP 2992 192848 4/2002

* cited by examiner

*Primary Examiner*—Daniel C. Crane
(74) *Attorney, Agent, or Firm*—Kathryn A. Marra

(57) ABSTRACT

A method is disclosed for forming sheet metal articles, such as automotive body panels, having significant curvatures in front-to-back and side-to-side directions. Opposing, complementary, preforming and final shape forming tools are used in a single press. A sheet of superplastically or quick plastically formable sheet metal alloy, heated to a forming temperature, is first stretched against the preform tool by the final shape tool to form a preform that has experienced most of the metal stretching required for the final part shape. The preform is removed from the preform tool and formed against the opposing, final shape tool with pressurized gas to obtain the final sheet metal part shape.

16 Claims, 3 Drawing Sheets

METHOD FOR STRETCH FORMING SHEET METAL BY PRESSING AND THE APPLICATION OF GAS PRESSURE

TECHNICAL FIELD

This invention pertains to high temperature forming of superplastically formable or quick plastically formable metal alloy sheet blanks into articles of complex curvature such as automotive body panels. More specifically this invention pertains to a double action forming tool and method for forming such blanks into sheet metal products with regions of high elongation without extreme uneven thinning or tearing or wrinkling of the sheet metal.

BACKGROUND OF THE INVENTION

Automotive body panels and other sheet metal parts of complex shape can be formed from aluminum alloys of superplastically or quick plastically formable composition and metallurgical microstructure. Superplastic deformation of, for example, Aluminum Alloy 5083 occurs generally between 900 F and 950 F, and the mechanism is grain boundary sliding of very fine grains. Quick plastic deformation of suitable aluminum alloys is described in U.S. Pat. No. 6,253,588, entitled "Quick Plastic Forming of Aluminum Alloy Sheet Metal" to Rashid, et al. Quick plastic forming is practiced at lower temperatures (e.g., 825 F to 875 F) and, often, at higher strain rates than superplastic forming. In quick plastic forming the deformation is not entirely by grain boundary sliding, it occurs both by grain boundary sliding and dislocation movement. Quick plastic forming produces complex parts with better dimensional quality and reproducibility of the shaped metal than the same parts made by superplastic forming.

Automobile designers and manufacturing engineers cooperate to specify the shape of aluminum alloy body panels that can be formed from sheet metal into the specified shape. An example of an automotive body panel is a deck lid. A typical deck lid has a generally horizontal surface for covering the top of the vehicle trunk and a generally vertical surface for defining the end of the trunk. Both surfaces usually have a curved shape as they span the vehicle trunk between the opposing vehicle fenders. Furthermore, the deck lid may have a deep pocket shaped recess in the vertical surface for a license plate and for lights that illuminate the plate. Also the deck lid may have a recess at the top of the vertical surface for a center high mounted stop lamp (CHMSL). When a body panel contains such structural features in a single piece of sheet metal consideration must be given to how the metal is stretched and formed without wrinkles and tears.

In evaluating the complex shape of such a body panel a finite element analysis can be made of the stretching of the flat sheet metal into the final product. Given the elongation properties of the sheet metal an assessment is made as to whether the part can be made from the available metal stock without tearing or wrinkling of the metal. It is an object of this invention to provide a markedly improved method of using superplastic forming or quick plastic forming as disclosed in the '588 patent to successfully form a part of complex shape with a high quality surface.

SUMMARY OF THE INVENTION

This invention is a method of using complementary, internally or externally heated, double action forming tools in a single press to form a superplastically or quick plastically formable metal alloy sheet metal blank into a sheet metal product of complex shape. One tool serves to define a preform shape for the part and the other tool defines the finish shape of the part. The tools are complementary, but not matching. The tools are used in a first action to mechanically impart a preform shape to the sheet metal blank. This preforming step involves substantial elongation of the sheet. In a second action, gas pressure is used with the finish shape tool to shape the preform into the final product. In a preferred embodiment the metal alloy is a magnesium-containing, aluminum alloy having a fine-grained microstructure (grain size suitably less than ten micrometers) for superplastic or quick plastic forming. Typically the sheet has a thickness in the range of about 0.7 to 3 mm.

The method is particularly applicable to forming the sheet metal into a stretch formed product of complex three-dimensional curvatures with recessed, pocket-like, regions of high elongation. For example, the invention is applicable to the forming of automotive vehicle body panels.

In accordance with the invention an analysis is made of the lines of elongation required to form a final stretch formed part from an initially flat sheet metal blank. The aluminum alloy sheet metal blank will have been produced by a combination of hot rolling and cold rolling to a desired sheet thickness. The cold worked sheet is subjected to a static thermal re-crystallization operation to produce a suitable fine grained microstructure for superplastic or quick plastic forming of the sheet at an elevated temperature of, for example, 925 F or 850 F, respectively. The sheet may also have at least one surface that has a high quality finish acceptable as an external visible surface of an assembled vehicle. Of course, the quality of such a sheet metal blank surface must be preserved throughout panel forming operations. When a forming analysis of the part indicates to the manufacturing engineers that the part cannot be formed in one stretching operation without producing surface defects or tears, use of the subject process may be imperative.

In many instances panels of complex shape can be formed in a single press using usually self-heated, complementary, but not necessarily matching, forming tools in a two stage forming process. The tools are in opposing relationship and movable from an open position for insertion of a sheet metal blank. The blank is externally preheated to its forming temperature or heated by radiation and conduction from the tool surfaces. The tools are then moved to a first stage forming position in which the edges of the blank are gripped by a binder ring mechanism. The finish shape tool is of convex shape and often called a punch. The preform tool is generally concave. The punch tool is moved so as to stretch the sheet toward and into the cavity of the concave tool. Thus, the punch presses the blank against portions of the preform tool surface and preforms the blank. While the tools are now close together with the preformed blank stretched between them, the tools are not matching over the entire tool surface and the preform does not take the exact shape of the preform tool.

The finish shape tool and preform tool surface are now in a second stage forming position. Gas pressure is applied to the preform tool side of the blank to force it against the finish form tool to complete the shaping of the sheet metal blank. The press is then opened for removal of the formed part and insertion of a new blank.

The preform tool is shaped to accomplish a major portion of the stretching and elongation of the sheet. The finish tool completes bends and recessed corners and defines the finish shape of the sheet metal produced in this press operation. But, preferably, the majority of the metal stretching is accomplished in the preform step. In the preform step, the punch face pushes and stretches the sheet metal blank against the preform tool surface. In the finish form step, the pressure of a suitable working gas, such as air or nitrogen, is applied to the upper surface of the sheet metal blank. The blank is again pushed and stretched, this time against the finish shape tool. Thus, the necessary elongation lines or stretch directions in the sheet to form the part are predetermined. A substantial part of the elongation is accomplished in the preform step especially in the regions of critical deformation. The final elongation is accomplished by forcing the preformed sheet, using gas pressure, away from the preform tool against the shaping surfaces of the finish shape tool.

Preferably, the preform tool defines a generally concave cavity and the finish form tool has a generally convex punch surface. The blank is inserted between the tools with the high surface quality side facing the cavity tool for the preform step and so that the final forming of the part is accomplished with the back side, the non-critical side, of the blank engaging the punch surface.

This two stage forming process enables parts with complex curvatures, such as the above described deck lid, to be formed in a single press on a double action tool. The practice makes efficient use of the press bed and reduces part-to-part cycle time for making parts having complex shapes including regions of high elongation.

Other objects and advantages of the invention will be understood from a detailed description of a preferred embodiment which follows.

DESCRIPTION OF THE PREFERRED EMBODIMENT

Figure 1:
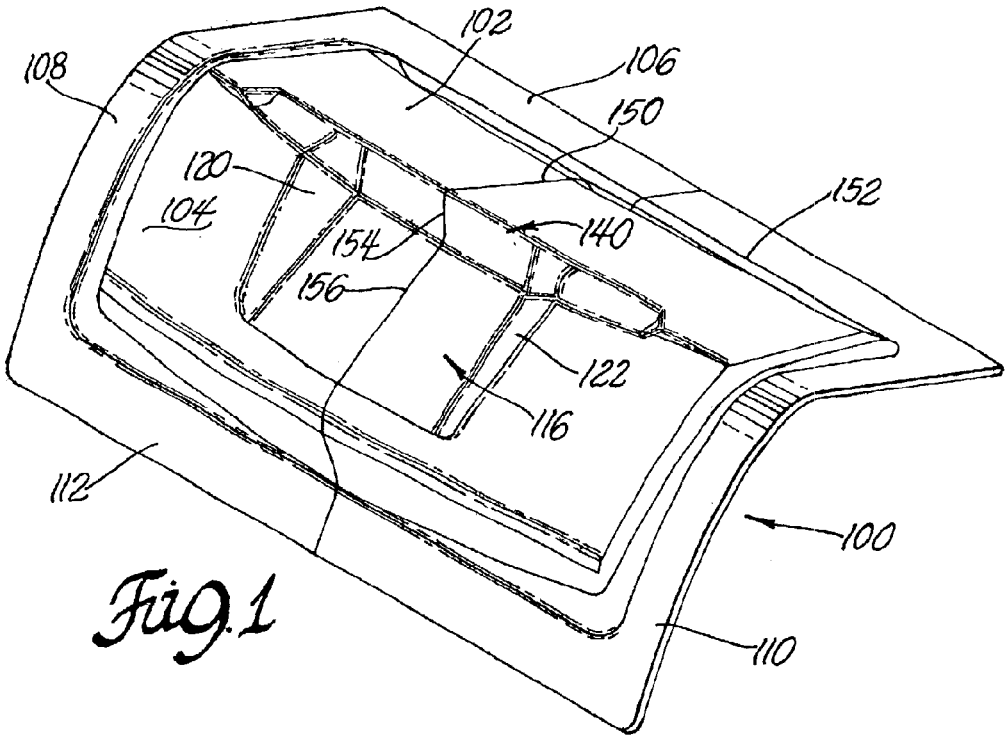
FIG. 1 is an isometric view of a preform structure from an AA5083 sheet metal blank of an automotive deck lid formed in accordance with this invention. In general the lines on the figure are silhouette lines of bends or other elongations in the sheet metal.

This invention is a process for the forming of superplastic or quick plastic metal alloy sheet blanks into articles of complex curvature and relatively high elongation. It is known that certain alloys of aluminum, magnesium, titanium, and steel, for example, can be subjected to relatively high elongation before they tear or crack. Typically, these superplastic metal alloys are processed in the form of sheet metal having a thickness of, for example, about 0.7–5 mm. In this sheet metal form, they can be heated to a suitable elevated temperature at which their high elongation forming properties can be exploited and they can be stretched and/or drawn over a suitable tool, or between suitable tools, to form sheet metal articles of complex shape. The practice of this invention will be illustrated using a known high elongation, fine grained, aluminum alloy, AA5083, which has been used for the manufacture of automobile body panels and the like. The same metal sheet can be formed by superplastic forming, SPF, or quick plastic forming, QPF. SPF is usually carried out at higher temperatures and lower strain rates. Progressively increasing gas forming pressures can be used in QPF at faster forming rates. The '588 patent is hereby incorporated by reference for its disclosure of QPF processes.

AA5083, has a typical composition by weight of about 4 percent to 5 percent magnesium, 0.3–1 percent manganese, a maximum of 0.25 percent chromium, about 0.1 percent copper, up to about 0.3 percent iron, up to about 0.2 percent silicon, and the balance substantially all aluminum. Such a composition is usually cast by a suitable process, and the casting is first hot rolled and then cold rolled to form a sheet with a thickness, for example, from about 0.7 to about 5 mm. After such cold rolling, usually one or both of the cold rolled surfaces of the sheet have a very smooth finish which is suitable for the external surface of an automobile body panel.

The cold rolled sheet metal has a severely worked, elongated grain microstructure that is not yet suitable for a SPF or QPF operation. The sheet material is annealed at a suitable temperature and for a time sufficient to recrystallize the cold worked grain structure. For superplastic forming in accordance with this invention the metallurgical microstructure of the sheet material is a stable uniformly fine grain structure usually in the range of about 5–10 micrometers or so. The microstructure is characterized by a principle phase of a solid solution of magnesium and aluminum with well distributed, finely dispersed particles of inter-metallic compounds containing minor alloying constituents, such as $Al_6Mn$. These aluminum-magnesium alloys can be heated to temperatures of the order of 850 F to 900 F, allowed to recrystallize into fine-grained microstructure, and then subjected to tensile type strains at a rate of $10^{-4}$ to $10^{-3}$ seconds$^{-1}$ to experience an elongation of up to 300% or more before tearing or other failure.

There is a class of automotive panels, such as deck lid outer panels, which, because of their visible surface quality requirements, are formed in such a way that the inside of the panel is in contact with the forming tool surface, often called the punch surface, and the exterior surface is left untouched. A key shape characteristic of such panels is the presence of two, large convex curvatures, which sweep the panels in both the cross-car and the car-length directions. When attempts are made to form such shapes starting from flat blanks, there is a high likelihood that wrinkles or metal folds occur at areas with male corners, that is, areas having entry corners in two directions at an angle. It is found that a good way to overcome this problem is to have a preform shape that is represented by large curvatures, yet has sufficient length-of-line for the final shape, and the surface of which is sufficiently close to potentially problematic areas of the final shape so that no wrinkling and metal folding tendencies would be expected during the final forming. Experience has shown that forming of a deck lid outer panel without utilizing a suitable preform generates metal folds that bridge the binder surface and the crown of the deck lid.

Two-stage forming can also reduce the overall forming time significantly. The punch pre-forming stage is completed quickly and is when a large part of the overall forming takes place. Since this panel has already sufficiently large length-of-lines, the second and final forming stage causes mostly bending-like deformation as opposed to metal stretching.

A structural advantage of a panel made with two-stage forming process is that, since the preformed panel with large curvatures has more evenly distributed forming strains, the final product also has a more even thickness distribution compared to that formed in a single-stage tool.

The practice of the invention on an AA5083 superplastic aluminum alloy sheet having, for example, 1.2 mm thickness will be described in connection with the forming of an automobile deck lid outer panel. A preform of the deck lid from a blank of AA5083 sheet metal is illustrated in FIG. 1 and the final form of the sheet metal deck lid outer panel is illustrated in FIG. 2.

Figure 2:
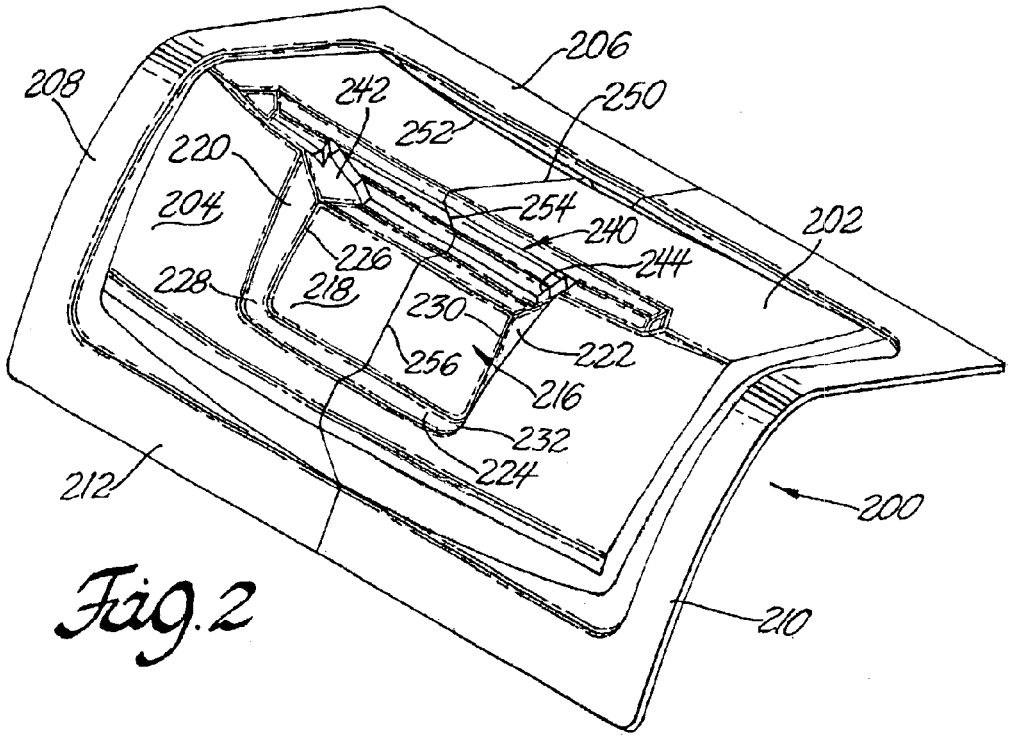
FIG. 2 is an isometric view similar to FIG. 1 of final formation of the sheet metal deck lid outer panel in accordance with this invention.

FIG. 2 will be referred to first for the purpose of describing the general shape, characteristics of an un-trimmed deck lid outer sheet metal panel as it is formed and removed from the tooling used in carrying out the process. The deck lid is indicated generally as 200 in FIG. 2. The lines of FIG. 2 illustrate the general shape of the deck lid that is formed in the original sheet metal blank. But the lines also show elongation lines and bends in the metal as it is formed by the process which will be described in more detail below.

As stated, FIG. 2 represents the formed sheet metal blank that has been shaped to contain a deck lid outer panel configuration 200. Excess metal at the edges of the formed sheet metal has not been trimmed away. In general, the deck lid configuration 200 comprises a horizontal surface 202 which covers the top of the trunk of the vehicle. Deck lid panel 200 also comprises a generally vertical surface 204 which defines the end of the trunk region of the vehicle. Edge 206 of the formed sheet metal contains material that can be used as a flange for attaching an inner panel to this outer deck lid panel 200 and the balance of the edge at 206 may be trimmed away in the finishing of the deck lid outer panel. Side edges 208 and 210 likewise represent flange material for securing an inner deck lid panel and trim stock that may ultimately be cut away from this formed sheet metal part. Finally, edge 212 at the bottom of vertical portion 204 of the deck lid 200 also provides flange and trim material.

A first significant feature critical to the successful forming of the deck lid panel 200 is an integrally formed deep pocket 216 for a license plate. The integrally formed license plate pocket 216 includes a generally flat bottom 218 with steeply sloped sides 220 and 222 and 224. The steeply sloped sides require significant stretching of the sheet metal. Side 220 forms a sharp radius corner portion 226 with bottom surface 218. Side 220 also forms a corner portion 228 with adjacent side 224. Similarly, side 222 forms a radius 230 with base portion 218 and a corner portion 232 with side 224. These are all features that have to be formed in the license plate pocket 216 that is integral with the sheet metal of the rest of the deck lid structure 200.

Also, integrally formed in the deck lid structure is a long narrow pocket 240 for a vehicle stop light that is called a center high mounted stop light (CHMSL). This long, narrow, and deep CHMSL pocket 240 has base portions and side walls that are not specifically labeled here for simplicity of illustration. Formed between license plate pocket 216 and CHMSL pocket 240 are pockets for the vehicle's back-up lights. One vehicle back-up light pocket 242 is visible in FIG. 2. These respective pockets represent critical, difficult to form, structural features in the sheet metal panel 200. Furthermore, the license plate recess 216 shares connected surfaces, not specifically labeled for simplicity of illustration, with the CHMSL pocket 240. These are structural features of a modern automobile body panel that test the formability of the sheet metal material from which such a body panel is formed.

As seen in FIG. 2 there is a central elongation line 250, which extends from edge 206, across the upper surface 202 of the deck lid 200, through the CHMSL pocket 240 and adjacent license plate pocket 216, across the vertical surface 204 to lower edge 212. The path traced by elongation line 250 illustrates a region of significant and relatively large elongation in the sheet metal from which deck lid outer panel 200 is formed.

Elongation line 250 crosses bend line 252 in the horizontal surface 202 of the deck lid. Elongation line then experiences a deep "U" portion 254 as it follows the bottom and side portions of the CHMSL pocket 240. Elongation line 250 then traces across the bottom 218 of license plate pocket 216 at 256 and up the side wall 224 of the license plate pocket 216. Elongation line 250 with its many sharply formed segments represents forming features in the final shape of panel 200. Accordingly, elongation line 250 will represent the section of the sheet metal panel 200 as it is seen in the press forming operations illustrated in FIGS. 3A through 3F which will be described in detail below.

FIG. 100 illustrates a preformed configuration 100 of the deck lid panel. Preform configuration 100 is the first stage forming configuration of the initially flat sheet metal AA5083 stock material. Much of the metal stretching and elongation for producing the final deck lid configuration has been produced in this preform. The original sheet metal blank has been sufficiently deformed at this preformed stage so that it is recognizable as a precursor of the deck lid structure illustrated in FIG. 2. The labeled bend lines and formed surfaces in this preform deck lid panel configuration 100 utilize "100" series numbers that otherwise correspond to similarly labeled, further formed lines and surfaces in FIG. 2. In other words, the horizontal deck lid surface of FIG. 1 is 102 and the vertical surface of the pre-formed deck lid structure is 104. Edges 106, 108, 110, 112 are precursor or pre-formed structures that correspond respectively to panel edges 206, 208, 210, 212 in FIG. 2. Sides 120, 122 are preformed stages of deeply sloped sides 220, 222. Similarly, license plate pocket 116 is the pre-formed version of license plate pocket 216 in the final form deck lid structure 200 of FIG. 2 and CHMSL pocket 140 is the preformed or precursor of the CHMSL pocket 240 in FIG. 2. Elongation line 150 is the pre-formed version of elongation line 250 in FIG. 2.

Again, elongation line 150 traces a path across bend line 152 in the horizontal surface 102 of pre-form panel configuration 100. Elongation line 150 has a sloped portion 154 in the preform CHMSL pocket 140. Elongation line 150 continues as 156 across the preform license plate pocket 116 and ultimately reaches the preform edge 112 of the pre-formed panel structure 100. Again, the preform elongation line 150 will be seen as a sectional view of the pre-formed structure 100 in the detailed description of the forming tools and the forming operation which will be described below in connection with FIGS. 3A–3F.

FIGS. 3A–3F are a series of schematic illustrations in cross section of an elevation view of press platens and two complementary, but not mating, forming tools useful in a preferred embodiment of the invention. They illustrate the forming the deck lid panel preform configuration 100 as illustrated in FIG. 1 and then the deck lid panel final configuration 200 as seen in FIG. 2. The respective tooling components are given the same identifying numbers when they are shown in more than one of the FIGS. 3A–3F.

Figure 3A:
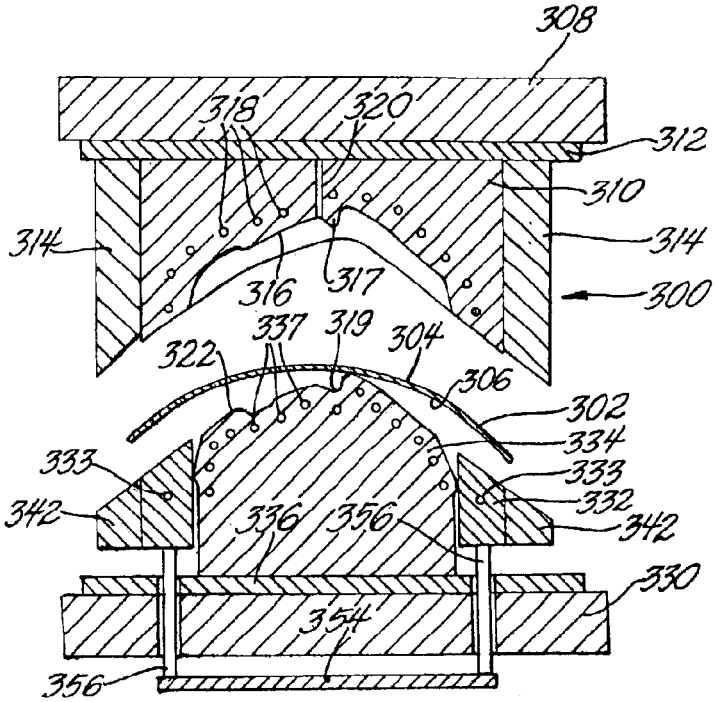
FIGS. 3A–3F are a series of cross-sectional views of the progressive operation of forming tools mounted on a press for superplastic or quick plastic stretch forming of the deck lid preform and final shape in accordance with a preferred embodiment of this invention.

Referring first to FIG. 3A, the press and tooling assembly is indicated generally and schematically at 300 and is shown in an open position for the insertion of a sheet metal blank 302. Blank 302 is shown in cross section and on edge. Sheet metal blank 302 has an upper surface 304 and a lower surface 306.

The press and tooling combination 300, comprises an upper press platen 308 (the full press structure and hydraulic actuating mechanisms are conventional and not shown to reduce the complexity of the illustration). Securely attached to upper press platen 308 is a cavity defining tool 310 which is generally concave in configuration with the principal exception of a CHMSL pocket preform shaping portion 317. An insulation layer 312 thermally isolates cavity tool 310 from upper platen 308. Similarly, the sides of cavity tool 310 are wrapped in insulation layers 314. Cavity tool 310 includes a cavity portion 316 for use in shaping the deck lid panel preform 100. Cavity tool 310 also comprises a plurality of heating elements 318 for maintaining the cavity tool at a temperature suitable for the thermoplastic forming of the AA5083 sheet material. A suitable tool temperature for QPF is, for example, 850 F. Cavity tool 310 also includes a gas port 320 for admitting a working gas under pressure for a finish shape panel forming operation to be described below. Air or nitrogen is typically used as the working gas. The working gas is vented through gas port 320 when the forming operation is completed.

The press lower platen 330 carries a binder ring 332 and a punch tool 334. Punch tool 334 is generally convex in configuration. Lying on press lower platen 330 is a layer of insulation material 336. There is also a layer of insulation material 342 enclosing binder ring 332. Binder ring 332 contains heating elements 333. Punch 334 likewise contains heating elements 337 for maintaining the punch tool at the specified forming temperature for the sheet metal blank 302. As seen in FIG. 3A the preheated sheet metal blank 302 is initially deposited on a finish shape surface 322 on punch 334 when the press/tool assembly 300 is in its open position. The hot flexible sheet drapes itself over punch 334 and binder ring structure 332.

With the flat sheet metal blank 302 loaded in the open press/tool assembly 300, the forming process now proceeds as follows.

Figure 3C:
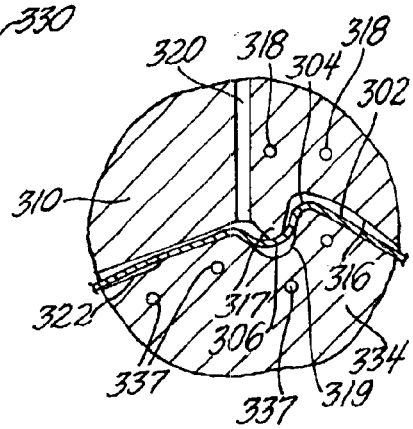
Figure 3B:
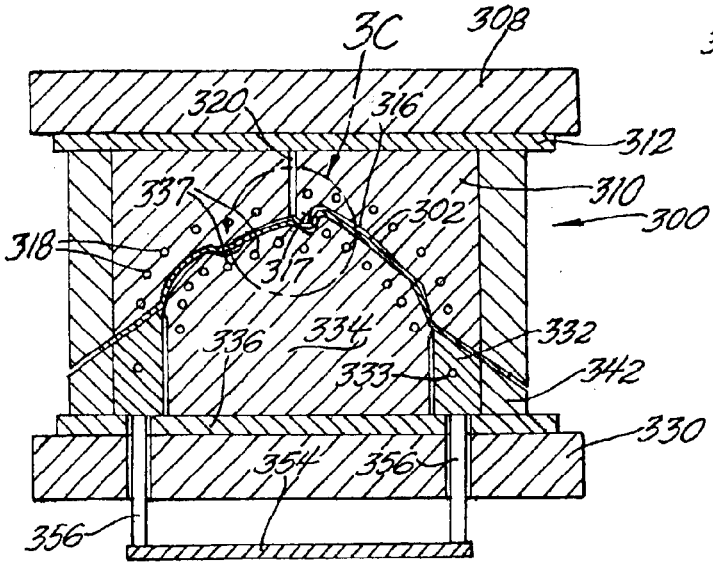
Figure 3D:
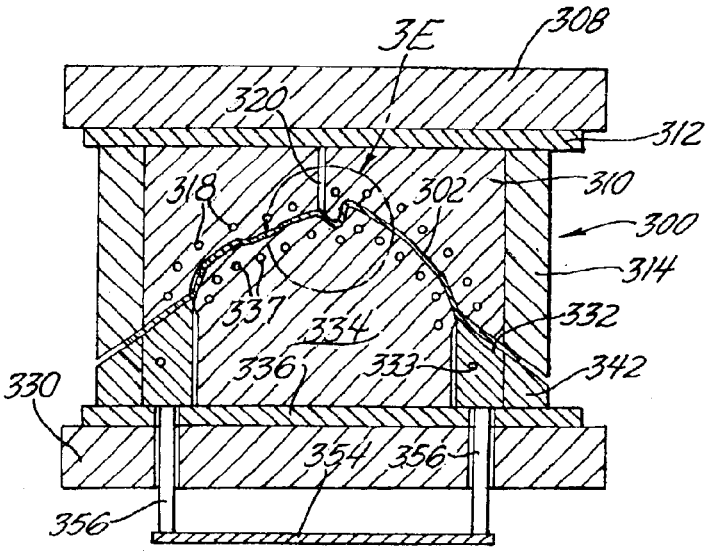
Figure 3E:
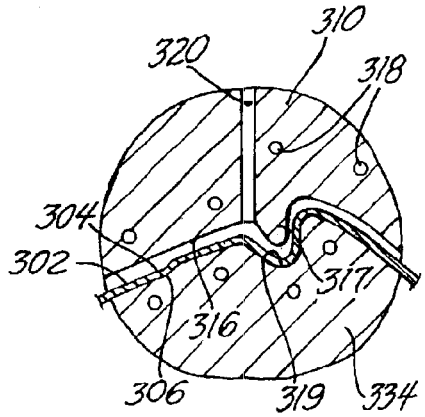

Referring to FIGS. 3A and 3B, the upper press platen 308/cavity tool 310 assembly is now closed against the punch 334/binder ring 332 combination. When the relative movement of upper platen 308 and lower platen 330 commences, lower surface 306 of blank 302 is resting on finish shape surface 322. As press closure occurs, cavity tool 310 first presses the periphery of sheet blank 302 against binder ring 332. As illustrated in FIG. 3A binder ring 332 is located so that it presses blank 302 against cavity tool 310 before punch 334 commences stretching of blank 302. This action secures blank 302 for the stretch preforming operation.

Binder ring 332 is carried on support rods 356 which in turn are carried by binder ring platen 354. Thus binder ring 332 can "float" with respect to punch 334 and platen 330. That is, binder ring 332 can be moved independently of punch 334 for the double-action effect of the press/tool assembly 300.

Relative movement of upper platen 308 and lower platen 330 closes the press/tool assembly 300 to the FIG. 3B position. The steady punch 334 motion and force obtained during relative closing of platens 308, 330 and 354 preforms blank 302 in the relative shape formed between the non-matching cavity tool 310 and punch 334. Binder ring 332 tightly secures the periphery of the sheet metal blank 302 during this process. As seen in FIG. 3B binder platen 354 is now spaced further from punch platen 330 than in FIG. 3A because punch 334 has moved relative to binder ring 332 in preforming blank 302.

As the platens are moved to a predetermined closing position, the preheated blank 302 is preformed between surfaces 316, 317 of the cavity tool 310 and finish shape surface 322 of punch tool 334. Although the opposing surfaces generally conform to each other, they do not actually match or touch. Shaping portion 317 acts to stretch or stuff an underlying portion of sheet metal blank 302 into a CHMSL pocket cavity portion 319 of punch tool 334. But there is not complete contact between the sheet metal 302 and shaping surfaces 316, 317 of cavity tool 310 and shaping surfaces 319, 322 of punch tool 334. Shaping portion 317 is not a perfect match with opposing finish shape surface cavity 319, thus a space is formed between lower surface 306 and cavity 319. This space and others like it leave room for further detailed bending of the sheet metal blank in the final forming step. FIGS. 3B and 3C present sectional views of the preform 100 of FIG. 1 along elongation line 150.

FIG. 3C is an enlarged view of the circled region of FIG. 3B. As seen in FIG. 3C, the partial closure of punch tool 334 and cavity tool 310 forces the blank 302 into general compliance with both opposing surfaces. The opposing surfaces, particularly shaping portion 317, are designed to leave spaces where blank 302 only contacts one of the surfaces. Cavity 319 is a region with one such space where the final shape tool 334 and blank 302 are protected and do not suffer damage in the preforming step.

The punch preforming step is complete in a single press closing motion. The heated blank 302 has assumed the deck lid panel preform shape 100 as illustrated in FIG. 1. Most of the metal stretching required to make the final deck lid shape is introduced in the preform 100. Final bending and corner details and the like are accomplished in the next forming stage.

As initially described above and now further shown in FIGS. 3A, 3B, 3D and 3F, punch tool 334 is carried by the lower press platen 330. Rods 356 that extend through lower press platen 330 and insulation layer 336 connect a punch platen 354 to binder rings 332. In FIGS. 3A and 3B, punch platen 354 is actuated by means, not shown, to move binder ring 332 independent of lower press platen 330 to allow binder ring 332 to properly secure blank 302 during both stages of the forming process.

After sheet metal blank 302 has been shaped as preform panel 100 as illustrated in FIGS. 3B and 3C, the punch tool 334 and cavity tool 310 are now in position for the finish sheet metal forming step. Gas pressure is introduced from the cavity tool 310 through gas duct 320 to the upper surface 304. Sheet metal 302 is forced away from the preform tool in the regions where it is in contact with cavity portions 316, 317. Back surface 306 is bent into full contact with the surface of punch tool 334 as shown in the enlarged view of FIG. 3E. The air pressure is gradually increased in increments as described in the Rashid et al patent '588 and within a period of a few minutes the sheet metal (shaped as preform 100, FIG. 1) has been stretched against the surface of the punch tool 334 so that it assumes the final deck lid panel configuration 200, FIG. 2, obtained in this tool/press assembly 300. The air pressure is then released through gas duct 320.

Figure 3F:
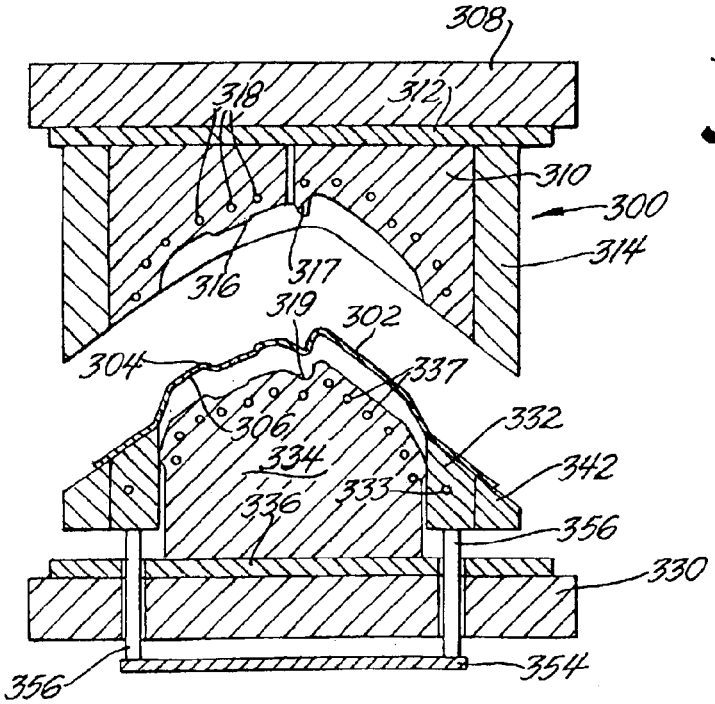

As illustrated in FIG. 3F, the cavity tool 310 and punch tool 334 are now separated by activation of their respective platens 308, 330 and 354. The formed sheet metal 302, which is now in the configuration of final formed deck lid panel sheet 200 (FIG. 2), is seen resting on the binder ring 332 in the open tooling/press assembly 300. By comparing FIG. 3D and FIG. 3F it is seen that binder ring 332 has been raised with respect to punch 334 to lift the formed sheet from punch 334.

Sheet metal 302, now deck lid panel sheet 200, is removed from the tool/press assembly 300. Any trimming operations and the like are accomplished to finish the making of the deck lid outer panel. The press is now in its open position and the tooling is ready for the insertion of a new blank 302 so that the process starts again to form the next deck lid panel as illustrated in FIG. 3A.

Thus, the subject invention provides a practice for two-stage forming in a single press of a deck lid outer panel sheet from a flat sheet metal blank. Much of the elongation that is to be produced in the sheet metal blank is accomplished in a preform step. This stretching and extending of the blank into the preformed shape permits the final detail forming of the license plate pocket and CHMSL pocket to complete the formation of this complex panel structure.

The double-action press used in the two-stage forming process of this invention enables the production of, for example, body panels with less extreme thickness distribution than can be formed in a single stage process. Thus, this invention enables the forming of more complex panel shapes and/or the use of lower cost, less formable sheet metal materials. For example, the starting sheet metal may not require as small a grain size as was used in the above illustrative embodiment. The high elongation sheet blanks may have adequate formability for the subject two stage forming method despite their larger grain sizes or because they are capable of undergoing grain size refinement under deformation at elevated forming temperatures.

The relative movement between the punch and binder ring used in the illustration of forming the deck lid can be obtained with a floating binder ring press design or a floating punch design. The above illustration used the floating binder ring. The floating punch design differs only in that the ring is the stationery element and the punch is the floating or moving element.

The actuation of movement of the moving element of the double-action tool, whether the punch or binder ring, does not have to come from the second action of a double-action press. The double-action forming concept can be exercised even on a single-action press by equipping the forming tool with self-cushioning. That is, the moving element of a double-action forming tool for use in this process can be actuated via shafts, levers, mating tapered sections or powered by external, press-mounted sources such as hydraulic cylinders or motors. In such a case the tool would be designated as self-cushioned.

The practice of the invention has been described in the example of forming of aluminum alloy AA5083 sheet metal blank into an automotive deck lid outer panel. However, it will be appreciated that similar practice can be applied to other superplastically or quick plastically formable sheet metal alloys and to the forming of other articles of manufacture.

Accordingly, the scope of the invention is not to be considered limited by the description of the specific examples.

What is claimed is:

1. A method of forming a sheet metal article from a blank of sheet metal that has been heated for stretch forming, said method being performed using a set of opposing tools, said tools comprising a punch having a punch surface defining a predetermined finish configuration for said article and a cavity tool having a cavity surface defining a preform configuration for said article, said method comprising:

placing a said blank between said opposing tools, said blank having a first side surface facing said cavity tool and a second side surface facing said punch;

pressing said punch against the second side surface of said sheet to push the first side surface of said sheet against said cavity tool surface to stretch and shape said blank in a sheet metal preform configuration that does not conform fully to either said cavity surface or said punch surface; and applying gas pressure to said first side surface of said blank to press said second side surface against said punch surface, but not against said cavity surface, to shape said blank from said sheet metal preform configuration to said finish configuration.

2. A method as recited in claim 1 comprising independently heating each of said opposing tools to a sheet metal stretch forming temperature and pressing said sheet between said punch and said cavity to stretch and shape said blank in a sheet metal preform configuration that does not conform fully to either said cavity surface or said punch surface, the amount of said stretching and shaping of said blank to form said preform being such that said shaping of said preform to said finish configuration does not tear or wrinkle said article.

3. A method as recited in claim 1 in which said blank has a thickness in the range of 0.7 to 5 millimeters.

4. A method as recited in claim 2 in which said blank has a thickness in the range of 0.7 to 5 millimeters.

5. A method as recited in claim 1 in which said blank is a magnesium-containing aluminum alloy.

6. A method as recited in claim 2 in which said blank is a magnesium-containing aluminum alloy.

7. A method as recited in claim 5 in which said blank is a magnesium-containing alloy having a grain size of about ten micrometers or less.

8. A method as recited in claim 6 in which said blank is a magnesium-containing alloy having a grain size of about ten micrometers or less.

9. A method of forming an article from a blank of sheet metal of a composition and metallurgical microstructure for high elongation stretch forming, said blank having been heated to a temperature for said stretch forming, said method being performed using opposing tools, said tools comprising a punch having a punch surface defining a predetermined finish configuration for said article and a cavity tool having a cavity surface defining a preform configuration for said article, said method comprising:

placing a said blank between said opposing tools, said tools then being in an open position, said blank having a first side surface facing said cavity tool and a second side surface facing said punch;

pressing said punch against the second side surface of said sheet to push the first side surface of said sheet against said cavity tool surface to stretch and shape said blank in a sheet metal preform configuration that does not conform fully to either said cavity surface or said punch surface; and then applying gas pressure to said first side surface of said blank to press said second side surface against said punch surface, but not against said cavity surface, to shape said blank from said sheet metal preform configuration to said finish configuration.

10. A method as recited in claim 9 comprising independently heating each of said opposing tools to a sheet metal stretch forming temperature and pressing said sheet between said punch and said cavity to stretch and shape said blank in a sheet metal preform configuration that does not conform fully to either said cavity surface or said punch surface, the amount of said stretching and shaping of said blank to form said sheet metal preform configuration being such that said shaping of said preform to said finish configuration does not tear or wrinkle said article.

11. A method as recited in claim 9 in which said blank has a thickness in the range of 0.7 to 5 millimeters.

12. A method as recited in claims 10 in which said blank has a thickness in the range of 0.7 to 5 millimeters.

13. A method as recited in claim 9 in which said blank is a magnesium-containing aluminum alloy.

14. A method as recited in claim 10 in which said blank is a magnesium-containing aluminum alloy.

15. A method as recited in claim 13 in which said blank is a magnesium-containing alloy having a grain size of about ten micrometers or less.

16. A method as recited in claim 14 in which said blank is a magnesium-containing alloy having a grain size of about ten micrometers or less.

* * * * *